US006168039B1

(12) United States Patent
Schwaikert

(10) Patent No.: US 6,168,039 B1
(45) Date of Patent: Jan. 2, 2001

(54) HOUSEHOLD PRODUCT PACKAGE

(75) Inventor: William E. Schwaikert, Lakeville, CT (US)

(73) Assignee: First Preference Products Corp., Lakeville, CT (US)

( * ) Notice: Under 35 U.S.C. 154(b), the term of this patent shall be extended for 0 days.

(21) Appl. No.: 09/306,291

(22) Filed: May 6, 1999

Related U.S. Application Data

(60) Provisional application No. 60/092,122, filed on Jul. 9, 1998, provisional application No. 60/090,697, filed on Jun. 24, 1998, and provisional application No. 60/084,733, filed on May 8, 1998.

(51) Int. Cl.[7] ..... B65D 1/02
(52) U.S. Cl. ..... 220/23.83; 206/501
(58) Field of Search ..... 220/23.83; 206/501

(56) References Cited

U.S. PATENT DOCUMENTS

| | | |
|---|---|---|
| D. 181,947 | 1/1958 | Scanland . |
| D. 220,831 | 6/1971 | Zimmerman et al. . |
| 769,171 | 9/1904 | Kray . |
| 1,735,885 | 11/1929 | Towle . |
| 2,111,884 | 3/1938 | Cahaney . |
| 2,299,277 | 10/1942 | Neuschaefer . |
| 2,641,374 | 6/1953 | Der Yuen . |
| 2,661,872 | 12/1953 | Trautvetter . |
| 3,176,879 | 4/1965 | Mojonnier . |
| 3,474,843 | 10/1969 | Maris . |
| 3,765,574 | 10/1973 | Urquiza . |
| 4,632,268 | 12/1986 | Melzi et al. . |
| 4,664,260 | 5/1987 | Stokes . |
| 4,691,828 | 9/1987 | Slusarczyk et al. . |
| 4,708,253 | 11/1987 | Mednis . |
| 4,805,793 | 2/1989 | Brandt et al. . |
| 4,851,351 | 7/1989 | Akamine . |
| 5,002,199 | 3/1991 | Frahm . |
| 5,119,972 | 6/1992 | Reed et al. . |
| 5,199,570 | 4/1993 | McKenzie . |
| 5,265,743 | 11/1993 | Frohn . |
| 5,299,710 | 4/1994 | Welsch et al. . |
| 5,480,028 | 1/1996 | Robinson . |
| 5,573,698 | 11/1996 | Mandler et al. . |
| 5,779,051 | 7/1998 | Boutin . |

*Primary Examiner*—Joseph M. Moy
(74) *Attorney, Agent, or Firm*—Akin, Gump, Strauss, Hauer & Feld, L.L.P.

(57) ABSTRACT

A container for dispensing a product is provided. The container is a generally parallelepiped container including two lateral, opposite side panels and two longitudinal, opposite side panels. Each side panel is interconnected with adjacent side panels, and each side panel has a lower and an upper edge. The container further includes a bottom panel extending from and interconnects the lower edges of each of the lateral and longitudinal side panels. A top panel extends from and interconnects the upper edges of each of the lateral and longitudinal side panels. A dispensing neck extends generally upwardly from the top panel proximate to a corner formed by an intersection of the top panel with two adjacent side panels. A cover member is removably disposed over an open end of the dispensing neck. The bottom panel has a recessed area which is generally aligned with the dispensing neck. The size of the recessed area is slightly greater than the size of the dispensing neck and the cover member, whereby when a plurality of such packages are stacked one on top of another in a stack, the dispensing neck and the cover member of each underlying package is received within the recessed area of an overlying package such that none of the weight of any overlying package is borne by the cover member and dispensing neck of an underlying package and so that a package can be displaced in one of a first lateral and a first longitudinal direction from the stack of packages for dispensing.

4 Claims, 1 Drawing Sheet

HOUSEHOLD PRODUCT PACKAGE

CROSS REFERENCE TO RELATED APPLICATIONS

This application claims the benefit of U.S. Provisional Application No. 60/092,122, filed Jul. 9, 1998, U.S. Provisional Application No. 60/090,697, filed Jun. 24, 1998, and U.S. Provisional Application 60/084,733, filed May 8, 1998.

BACKGROUND OF THE INVENTION

The present invention relates generally to packaging and, more particularly, to packaging for products such as household products, particularly such packaging which is suitable for, but not restricted to, dispensing from coin operated or other automated dispensing equipment.

Currently, many household products, particularly individual portions of household products such as laundry detergent, bleach, etc. which are dispensed from machines, such as in laundromats, are rectangular packages of standard dimensions to facilitate dispensing from within two primary types of coin operated dispensing equipment. The packaging of powders, liquids and sheets generally use rectangular paperboard cartons of a predetermined length, width and height to fit the specifications of the dispensing machinery. Liquids are first packaged in flexible liquid tight substrates or pouches and are then placed in paperboard cartons of a suitable size and shape so that they may also be dispensed with the same equipment. Conventional liquid packages positioned so that the opening feature is on a horizontal plane and having a size and shape to fit the specifications of existing dispensing machinery have also been used. Such extant packaging is problematic in that product leakage is a significant factor resulting in potential personal injury and property damage. In addition, the cost of providing such packaging is high.

Other packages, such as those disclosed by U.S. Pat. Nos. 2,299,277, 2,641,374, 4,708,253, 4,805,793, 5,002,199, and 5,480,028 disclose a variety of stackable packages which have generally parallelepiped shapes, dispensing necks, and clearance areas to permit stacking of packages. However, these patents also disclose engagement of the bottom surface of the overlying package with the top surface of the underlying package in a locking arrangement which is unsuitable for use in dispensing equipment. While still other packages, such as those disclosed by U.S. Pat. Nos. 2,111,884, 3,176,879, 3,474,843, 3,765,574, 5,265,743, 5,299,710, 5,779,051, Des. 181,947, and Des. 220,831 disclose stackable packages without locking engagement, none of the afore-mentioned patents disclose stackable packages that can be utilized in a dispensing machine.

The present invention comprises a universal polymeric package which can be, but does not have to be, used for dispensing powders, liquids or virtually anything else from a standard coin operated or other dispensing machine. Packaging made in accordance with the present invention is structurally superior to prior art packaging due to the position and vertical location of the opening feature and the design which permits a multiplicity of such packages to be stacked one on top of the other without creating undue pressure on the opening feature or other portion of the bottom package or any intervening package which could result in breakage or leakage.

SUMMARY OF THE INVENTION

Briefly, the invention is a package for containing a product for use with standard dispensing equipment. The package comprises a generally parallelepiped container including two lateral, generally parallel, opposite side panels and two longitudinal, generally parallel, opposite side panels. Each side panel is interconnected with adjacent side panels, and each side panel has a lower edge and an upper edge. The container further includes a bottom panel extending from and interconnecting the lower edges of each of the lateral and longitudinal side panels, and a top panel extending from and interconnecting the upper edges of each of the lateral and longitudinal side panels. The package further comprises a dispensing neck extending generally upwardly from the top panel proximate to a corner formed by the top panel and two adjacent side panels. The dispensing neck has an open end, a predetermined length, a predetermined width and a predetermined height. The package further comprises a cover member removably disposed over the open end of the dispensing neck. The cover member has a predetermined length, a predetermined width and a predetermined height. The bottom panel has a recessed area generally aligned with the dispensing neck. The recessed area has a length slightly greater than the longer of a combination of the dispensing neck and the cover member, a width slightly greater than the wider of the combination of the dispensing neck and the cover member, and a height slightly greater than a combination of the height of the dispensing neck and the cover member disposed above the dispensing neck whereby when a plurality of such packages are stacked one on top of another the dispensing neck and the cover member of each underlying package is received within the recessed area of an overlying package such that none of the weight of any overlying package is borne by the cover member and dispensing neck of an underlying package. The packages can be stacked on top of one another within standard dispensing equipment. A package can be displaced in one of a first and second lateral and a first and second longitudinal direction from the stack of packages for dispensing from the standard dispensing equipment.

The invention is also a package for containing a product. The package comprises a generally parallelepiped container including two lateral, generally parallel, opposite side panels and two longitudinal, generally parallel, opposite side panels. Each side panel is interconnected with adjacent side panels, and each side panel has a lower edge and an upper edge. The container further includes a bottom panel extending from and interconnecting the lower edges of each of the lateral and longitudinal side panels, and a top panel extending from and interconnecting the upper edges of each of the lateral and longitudinal side panels. The package further comprises a dispensing neck extending generally upwardly from the top panel proximate to a corner formed by the top panel and two adjacent side panels. The dispensing neck has an open end, a predetermined length, a predetermined width and a predetermined height. The package further comprises a cover member removably disposed over the open end of the dispensing neck. The cover member has a predetermined length, a predetermined width and a predetermined height. The bottom panel has a recessed area generally aligned with the dispensing neck. The recessed area has a length slightly greater than the longer of a combination of the dispensing neck and the cover member, a width slightly greater than the wider of the combination of the dispensing neck and the cover member, and a height slightly greater than a combination of the height of the dispensing neck and the cover member disposed above the dispensing neck whereby when a plurality of such packages are stacked one on top of another the dispensing neck and the cover member of each underlying package is received within the recessed area of an overlying package such that none of the weight of any overlying package is borne by the cover member and dispensing neck of an underlying package. The packages can be stacked on top of one another. A package can be displaced in one of a first and second lateral and a first and second longitudinal direction from the stack of packages for dispensing.

BRIEF DESCRIPTION OF THE SEVERAL VIEWS OF THE DRAWINGS

The following detailed description of a presently preferred embodiment of the invention will be better understood when read in conjunction with the appended drawings. For the purpose of illustrating the invention, there are shown in the drawings an embodiment which is presently preferred. It should be understood, however, that the present invention is not limited to the particular arrangements and instrumentalities shown. In the drawings.

DETAILED DESCRIPTION OF THE INVENTION

The present invention comprises a package for containing a product such as household goods or other products of the type which can be, but does not have to be, dispensed from a standard coin operated or other dispensing machine. In particular, the presently described embodiment of the present invention comprises a standard sized package which is sized to be usable within standard dispensing machines and which has substantial structural integrity such that a large number of such packages, with the product therein, can be stacked one upon another without resulting in damage, leakage or the like to the bottom package or any of the intervening packages.

Figure 1:
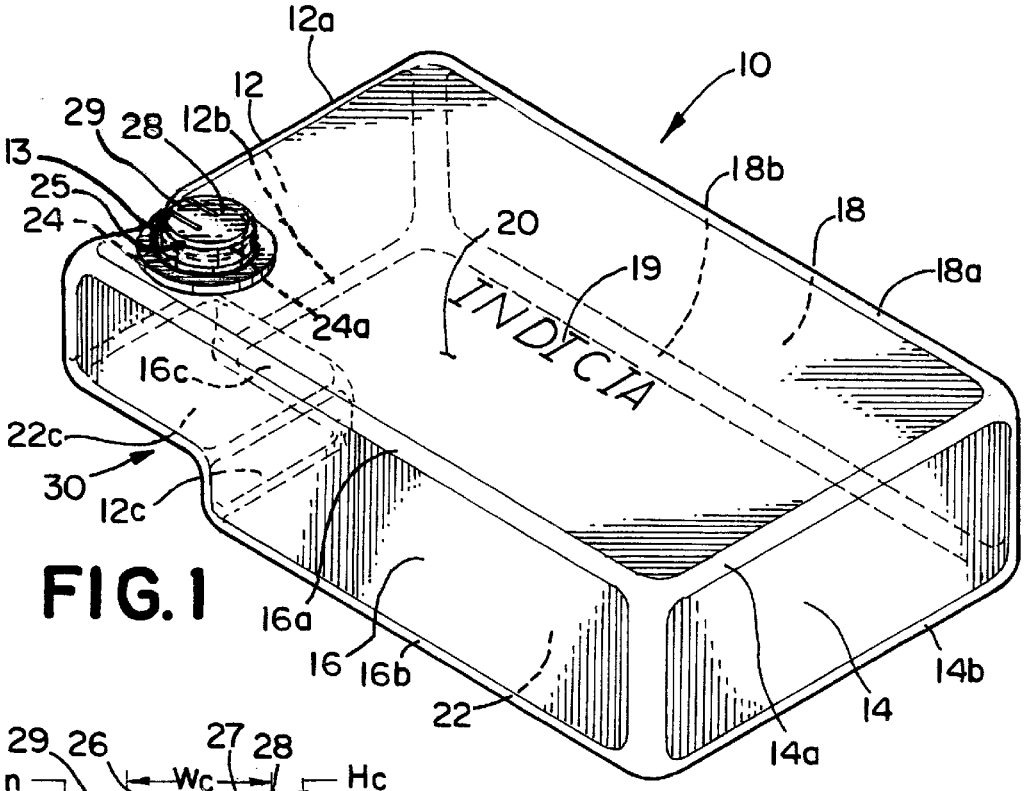
FIG. 1 is a perspective view of a package in accordance with a preferred embodiment of the present invention.

FIG. 1 illustrates a package 10 in accordance with a preferred embodiment of the present invention. The package 10 is generally a parallelepiped container in overall shape with generally parallel opposite lateral side panels 12 (in phantom), 14, generally parallel opposite longitudinal side panels 16, 18 (in phantom) and generally parallel opposite top and bottom panels 20, 22 (in phantom), respectively. Each side panel 12, 14, 16, 18 is interconnected with adjacent side panels as shown in FIG. 1. Each side panel 12, 14, 16, 18 has an upper edge 12*a*, 14*a*, 16*a*, 18*a* and a lower edge 12*b*, 14*b*, 16*b*, 18*b*, respectively.

The top panel 20 extends from and interconnects the upper edges 12*a*, 14*a*, 16*a*, 18*a*, of each of the side panels 12, 14, 16, 18, respectively. The top panel 20 also includes a generally cylindrically shaped dispensing neck 24 extending generally upwardly from the plane of the top panel 20. Preferably, for reasons that will become apparent, part of one of the panels 12, 14, 16, 18 (panel 12 as shown in FIGS. 1–3) includes a panel indentation 13 proximate to the dispensing neck 24.

Preferably, the dispensing neck 24 is generally located proximate to a corner formed by the top panel 20 and the upper edges 12*a*, 14*a*, 16*a*, 18*a* of two adjacent side panels 12, 14, 16, 18, respectively. In the illustrated embodiment, indicia 19 in the form of a preprinted label, is secured to the top panel 20 by a suitable adhesive. However, it will be appreciated by those skilled in the art that the indicia 19 could be applied to the top panel 20 in any other manner and, if desired, could be formed as an integral or molded in part of the top panel 20 during the manufacturing process.

Preferably, the dispensing neck 24 is right circular cylindrically shaped, although those skilled in the art will realize that the dispensing neck 24 can be other shapes, including, but not limited to, right oval cylindrically shaped or frustoconically shaped. Referring to FIGS. 1–3, the dispensing neck 24 has a tapered lip 24*a* surrounding an open end 25, a predetermined length $L_n$, a predetermined width $W_n$, and a predetermined height $H_n$. The lip 24*a* has a lip indentation 24*b* aligned with the panel indentation 13 for reasons that will become apparent.

Figure 2:
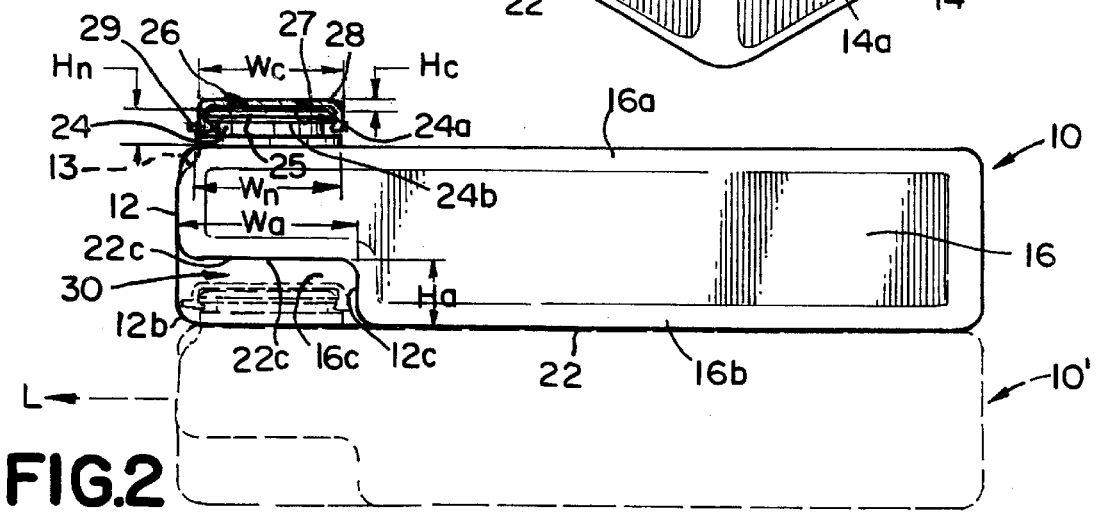
FIG. 2 is a longitudinal side elevational view of the package of FIG. 1, partially in section, overlying a second package shown in phantom.
Figure 3:
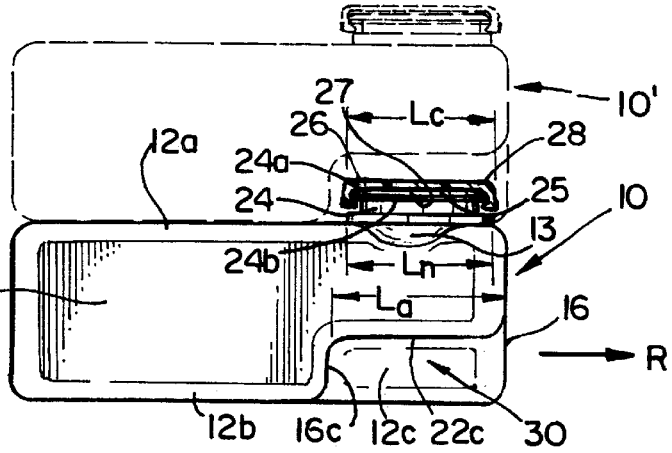
FIG. 3 is a lateral left side elevational view, partially in section, of the package of FIG. 1 underlying a second package shown in phantom.

In the illustrated embodiment, as shown in FIGS. 1–3, the dispensing neck 24 is covered by a seal 26 which is removably disposed over the open end 25 of the dispensing neck 24. Preferably, the seal 26 includes a tab 27, which a user can grasp to remove the seal 26 from the dispensing neck 24. Preferably, the seal 26 is made of Tyvek® or some other breathable fabric to allow gases which may build up in the package 10 to be released from the package 10 without leaking any product held within the package 10. Alternatively, the seal 26 can be selected from the group consisting of polymeric films, aluminum foils, metallic foils, paper foils, leak proof films, leak proof foils, polypropylene, polyvinyl chloride, polyethylene, and polystyrene. The seal 26 can be secured to the dispensing neck 24 by one of an adhesive, induction sealing, and sonic welding or other comparable methods known to those skilled in the art.

Preferably, the seal 26 is covered by a cover member 28 which is rotatably affixed over the lip 24*a* of the dispensing neck 24. The cover member 28 also includes a tab 29. The cover member 28 is preferably a child proof or child resistant closure. The cover member 28 has a predetermined length $L_c$, a predetermined width $W_c$, and a predetermined height $H_c$ above the dispensing neck 24. The cover member 28 can be of a type that must be torn or otherwise damaged to be removed from the package 10, precluding the reuse of the cover member 28 on the package 10. Alternatively, a screw-on cap (not shown) can be used with a threaded dispensing neck (not shown), permitting the package 10 to be opened and re-closed for partial dispensing of the product contained therein and/or resealing of the package 10. It should be understood by those of ordinary skill in the art that the package 10 and, in particular, the dispensing neck 24 could alternatively be closed in some other manner. For example, the open end 25 of the dispensing neck 24 could be covered by a resealable or non-resealable foil, a flip-top cap or the like. Accordingly, the present invention is not limited to a particular manner in which the package 10 may be initially closed or subsequently re-closed or even whether the package may be reclosable. However, those skilled in the art will also realize that the cover member 28 with tab 29 can be omitted without departing from the spirit and scope of the present invention. The lip 24*a* can also be omitted, and the open end 25 of the dispensing neck 24 can be flat, instead of tapered.

The bottom panel 22 extends from and interconnects the lower edges 12*b*, 14*b*, 16*b*, 18*b* of each of the side panels 12, 14, 16, 18, respectively. The package 10 includes a single recessed area 30 on the bottom panel 22 which is generally aligned with the dispensing neck 24. The recessed area 30 is formed by panels 12*c*, 16*c*, and 22*c* as shown in FIG. 1.

The recessed area 30 has a width $W_a$ which is slightly greater than the wider of a combination of the dispensing neck 24 and the cover member 28. Likewise, the recessed area 30 has a length $L_a$ which is slightly greater than the longer of the combination of the dispensing neck 24 and the cover member 28. Further, a height $H_a$ of the recessed area 30 is slightly greater than the height $H_n$ of the dispensing neck 24 and the height $H_c$ of the cover member 28 disposed above the dispensing neck 24. The recessed area 30 thus effectively establishes clearance sufficient to permit the stacking of a plurality of packages 10, one on top of the other within a box or other packaging or within standard dispensing equipment (not shown), in a manner illustrated in FIGS. 2 and 3 so that the cover member 28 and the dispensing neck 24 of each underlying package 10' (in FIG. 2), 10 (in FIG. 3) is received within the recessed area 30 of an overlying package 10 (in FIG. 2), 10' (in FIG. 3). In this manner, the cover member 28 and the dispensing neck 24 of each underlying package 10 do not engage the bottom panel 22 of any overlying package 10 and therefore do not bear the weight of any packages stacked thereon. It will be appreciated that by positioning the dispensing neck 24 within the recessed area of an overlying package, it is feasible to dispense the bottommost package 10, 10' from a series of stacked packages for dispensing from the standard dispensing equipment by merely displacing the bottommost package in either of a first longitudinal and a first lateral direction, i.e. toward the left (arrow "L" in phantom) when viewing FIG. 2 or toward the right (arrow "R") when viewing FIG. 3. However, those skilled in the art will realize that a topmost package 10', 10 can also be dispensed by displacing the package in either of a second longitudinal and a second lateral direction.

An intersection of any panel 12, 12*c*, 14, 16, 16*c*, 18, 20, 22, 22*c* with an adjacent panel 12, 12*c*, 14, 16, 16*c*, 18, 20, 22, 22*c* forms an edge. An intersection of any panel 12, 12*c*, 14, 16, 16*c*, 18, 20, 22, 22*c* with two adjacent panels 12, 12*c*, 14, 16, 16*c*, 18, 20, 22, 22*c* forms a corner. Preferably, any and all edges and corners that are formed on the package 10 are rounded. The rounding relieves stress concentrations at the corners and edges.

As stated above, the dispensing neck 24 is preferably located proximate to a corner of the top panel 20 (shown as the corner formed by panels 12, 16, and 20). Locating the dispensing neck 24 in a corner facilitates pouring of a liquid or powder from the package 10 and provides a larger, generally continuous area on the top panel 20 for the placement of the indicia 19 indicative of the contents of the package 10.

It will be appreciated by those skilled in the art that, while it is more preferred that the dispensing neck 24 is located proximate to a corner of the package 10, the dispensing neck 24 may be located in virtually any position along any of the edges of the top panel 20 as long as the recessed area 30 is suitably sized and positioned under the dispensing neck 24 to facilitate proper stacking and dispensing of the bottommost or topmost package 10.

Additionally, it will be appreciated by those skilled in the art that, while the height $H_a$, the length $L_a$, and the width $W_a$ of the recessed area 30 are preferably only slightly larger than the height $H_n$ of the dispensing neck 24 and the height $H_c$ of the cover member 28 above the dispensing neck 24, the longer of the combination of the dispensing neck 24 and the cover member 28, and the wider of the combination of the dispensing neck 24 and the cover member 28, respectively, any or all of the height, length and width $H_a$, $L_a$, $W_a$, respectively, of the recessed area 30 can be substantially larger than a minimum dimension.

Preferably, the package 10 is made of a strong polymeric material, such as a polypropylene, polyvinyl chloride, polyethylene, polystyrene or the like in monolayers or multilayers in order to provide a strong, lightweight, inexpensive package which guards against leakage of any product contained therein. Preferably, the package 10 is made utilizing a known molding or blow molding process in a manner well known to those of ordinary skill in the art.

By having the dispensing neck 24 extend above the plane of the top panel 20 of the container 10, the level of any liquid in the container, when stored in an upright level condition, is never high enough to be in contact with an interior of the seal 26. In this manner, the potential for deterioration of the seal 26 and subsequent product leakage is diminished.

It will also be appreciated by those of ordinary skill in the art that while the present package 10 may be best suited to dispense liquid products, the package 10 could be used for dispensing solid or semi-solid products such as granular laundry detergent or the like. Because no weight is placed on the dispensing neck 24, the package 10 may be stacked to significant heights without resulting in the rupture of any package in the stack or the disruption of the dispensing equipment.

To open the package 10, the user rotates the cover member 28 so that the tab 29 is aligned with the lip indentation 24*b*. The user then grasps the tab 29, placing a finger in the panel indentation 13 between the side panel 12 and the tab 29, and pulls up on the tab 29, tearing or otherwise removing the cover member 28 from the package 10. The user then grasps the seal tab 27 and pulls the seal 26 back, revealing the open end 25 of the dispensing neck 24.

Although the present invention is preferably for use with a standard vending machine, alternatively, a large number of the packages of the present invention can be stacked one on top of the other outside of a vending machine, for example, on a store shelf, without resulting in damage, leakage or the like to the bottom package or any of the intervening packages. The ability of the dispensing neck 24 and cover member 28 of one package 10 to fit within the recessed area 30 of an overlying package 10 reduces valuable store shelf space required on which to display the packages. Additionally, the ability of the dispensing neck 24 and cover member 28 of one package 10 to fit within the recessed area 30 of an overlying package 10 aids in packaging a large number of packages 10 in bulk for shipping and/or sampling outside of vending machines.

From the foregoing description of the preferred embodiment, it can be seen that the present invention comprises a package suitable for containing many different products and also well suited for use in a dispensing or vending machine. It will be appreciated by those skilled in the art that modifications may be made from the described embodiment without departing from the scope and spirit of the invention as defined by the appended claims.

What is claimed is:

1. In equipment for dispensing containers, the equipment for receiving a plurality of containers stacked one on top of another, the equipment operating to dispense one container at a time by sliding the bottom or top container out of the stack, each of the containers being generally in the shape of a parallelepiped including two lateral, generally parallel, opposite side panels and two longitudinal, generally parallel, opposite side panels, each side panel being interconnected with adjacent side panels, and each side panel having a lower edge and an upper edge, each container including a bottom panel extending from and interconnecting the lower edges of each of the lateral and longitudinal side panels, and a top panel extending from and interconnecting the upper edges of each of the lateral and longitudinal side panels, each container being sized and shaped to fit within the dispensing equipment, each container including a dispensing neck extending generally upwardly from the top panel proximate to a corner formed by an intersection of the top panel with two adjacent side panels, the dispensing neck having an open end, a predetermined length, a predetermined width and a predetermined height, and a cover member removably disposed over the open end of the dispensing neck, the cover member having a predetermined length, a predetermined width and a predetermined height, wherein the improvement comprises:

the bottom panel of each container includes a recessed area generally aligned with the dispensing neck, the recessed area having a length slightly greater than the longer of a combination of the dispensing neck and the cover member, a width slightly greater than the width of the combination of the dispensing neck and the cover member, and a height slightly greater than a combination of the height of the dispensing neck and the height of the cover member disposed above the dispensing neck such that when containers are stacked one on top of another within the dispensing equipment, the dispensing neck and the cover member of each underlying container is received within the recessed area of an overlying container with none of the weight of an overlying container being borne by the cover member or dispensing neck of an underlying container so that a container at either the top or the bottom of the stack of containers can be displaced by the dispensing equipment moving the container out of the stack of containers in one of a first and second lateral and a first and second longitudinal direction for dispensing the container from the dispensing equipment.

2. A container according to claim 1 wherein the cover member is secured to the dispensing neck by one of an adhesive, induction sealing, sonic welding, screw fit, and snapfit.

3. A container according to claim 1 wherein the container is made from a polymeric material.

4. A container according to claim 1 wherein the cover member is selected from the group consisting of polymeric films, aluminum foils, metallic foils, paper foils, leak proof films, leak proof foils, polypropylene, polyvinyl chloride, polyethylene, and polystyrene.

* * * * *